US006344783B1

(12) United States Patent
Neuhaus et al.

(10) Patent No.: US 6,344,783 B1
(45) Date of Patent: Feb. 5, 2002

(54) ELECTROMAGNET, SPECIALLY FOR ACTUATING VALVES

(75) Inventors: Rolf J. Neuhaus; Kurt R. Stratil, both of Lohr; Andreas Ehrenfels, Gemunden-Seifriedsburg; Frank Kattler; Hans-Jurgen Pauly, both of Puttlingen, all of (DE)

(73) Assignees: Hydraulic-Ring GmbH, Limbach-Oberfrohna; Hydac Electronic GmbH, Saarbrucken, both of (DE)

( * ) Notice: Subject to any disclaimer, the term of this patent is extended or adjusted under 35 U.S.C. 154(b) by 0 days.

(21) Appl. No.: 09/402,612

(22) PCT Filed: Feb. 17, 1998

(86) PCT No.: PCT/EP98/00893

§ 371 Date: Nov. 12, 1999

§ 102(e) Date: Nov. 12, 1999

(87) PCT Pub. No.: WO98/49696

PCT Pub. Date: Nov. 5, 1998

(30) Foreign Application Priority Data

Apr. 25, 1997 (DE) ..... 197 17 445

(51) Int. Cl.[7] ..... H01F 7/00
(52) U.S. Cl. ..... 335/278; 335/255

(58) Field of Search ..... 335/255, 260, 335/278, 281; 251/129.01–129.22

(56) References Cited

U.S. PATENT DOCUMENTS 3,303,445 A 2/1967 Flentge

FOREIGN PATENT DOCUMENTS

| | | | |
|---|---|---|---|
| DE | 19525058 | A1 | 3/1996 |
| DE | 4439422 | A1 | 6/1996 |
| DE | 19504185 | A1 | 8/1996 |
| FR | 2385199 | * | 10/1978 |
| FR | 2 686 387 | | 7/1996 |

* cited by examiner

*Primary Examiner*—Ramon M. Barrera
(74) *Attorney, Agent, or Firm*—Roylance, Abrams, Berdo & Goodman, L.L.P.

(57) ABSTRACT

An electromagnet for actuating valves includes a sheath-like magnet housing encompassing a pole core forming a one-sided closure of the housing. The housing is connected to the pole core by an annular groove in its periphery, by an O-ring accommodated in the groove as a sealing element and by an annular groove in the magnet housing. The magnet housing forms bearing surfaces joined in positive fit to the inner walls of the annular groove and a sealing surface located on the O-ring.

24 Claims, 1 Drawing Sheet

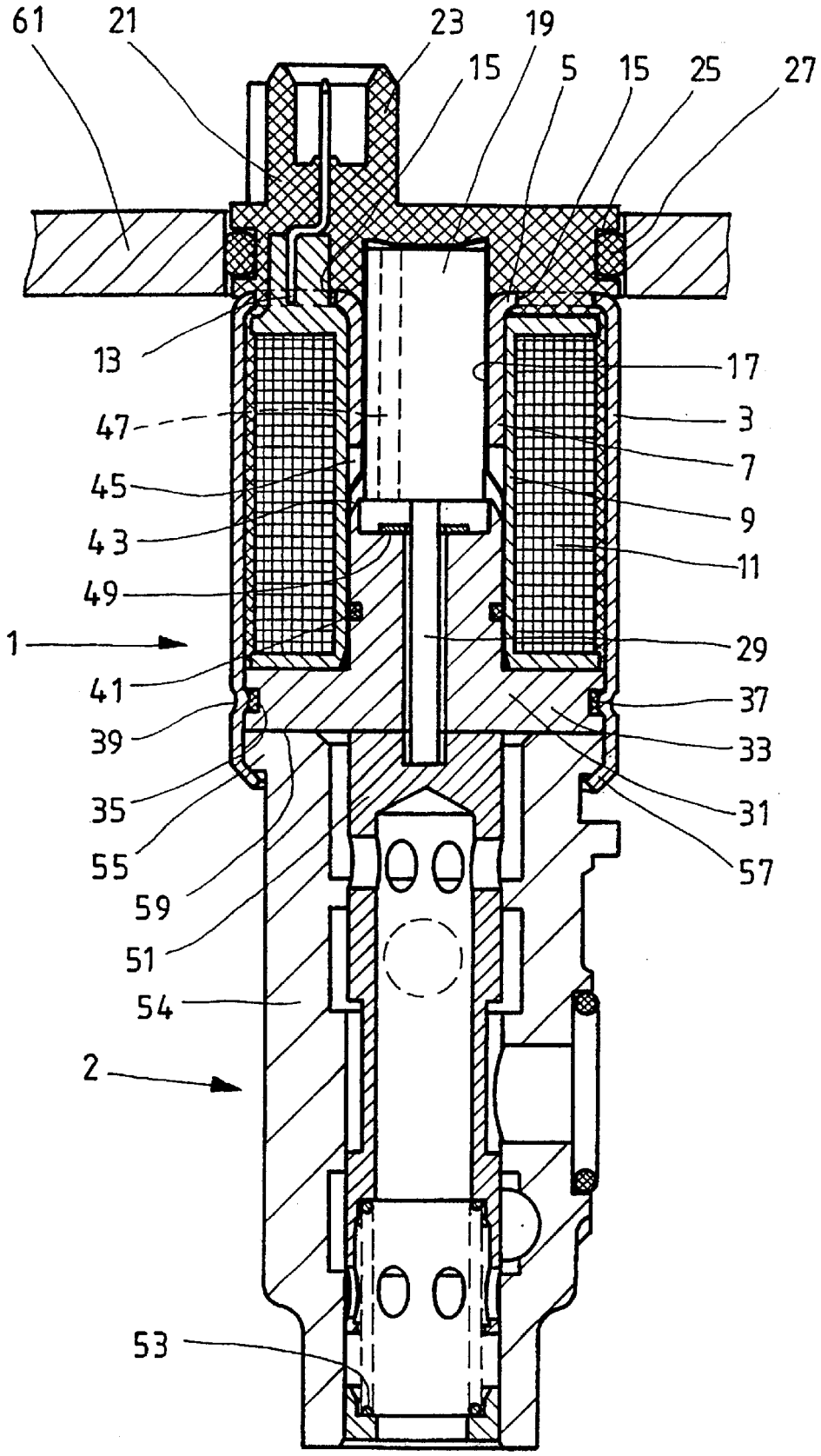
61
21
23
19
15
5
15
25
27
13
17
47
3
7
45
9
43
11
49
1
29
41
37
39
33
35
31
55
57
59
51
54
2
53

ELECTROMAGNET, SPECIALLY FOR ACTUATING VALVES

FIELD OF THE INVENTION

The present invention relates to an electromagnet, particularly for actuating valves, with a sheath-like magnet housing. The housing encompasses a pole core on the actuation side of the electromagnet. An actuation member is accessible on the electromagnet and is movable by means of the armature of the magnet. The magnet housing is connected with the pole core in an area adjacent to the actuating side by means of a connection which is tightly fitting at least in that area.

BACKGROUND OF THE INVENTION

An electromagnet for actuating valves is disclosed in DE 195 04 185 A1. For this electromagnet to satisfy requirements for higher structural resistance and problem-free sealing of the magnet housing from the exterior environment, which sealing is particularly important during its use for the actuation of hydraulic valves, a costly structure with considerable manufacturing outlay generally results for conventional valves.

SUMMARY OF THE INVENTION

Objects of the present invention are to provide an electromagnet for actuating valves which is relatively simple and inexpensive to manufacture, particularly in view of its especially beneficial sealing and resistance properties.

The objects of the present invention are attained by an electromagnet having a connection between its magnet housing and pole core incorporating an annular groove formed between magnet housing and pole core in the periphery of the pole core. A removable sealing element is fitted in that groove. Another annular groove in the magnet housing also engages the sealing element. The connection forms contacts surfaces by engaging tightly and fitting on the interior walls of the pole core annular groove, as well as a contacting sealing surface encompassing the sealing element.

By virtue of this construction, with tightly fitting application of the frictional connection between the magnet housing and pole core, a problem-free sealing by contact of the annular groove of the magnet housing on the sealing element located in the adjacent annular groove is obtained simultaneously. As opposed to conventional electromagnets, wherein grooves forming inwardly aligned openings are uniformly distributed around the periphery of the magnet housing to form the connection, the connection obtained according to the present invention is without penetrating openings passing all the way through for a pressure-sealed sealing off of the housing.

The sealing element can be an O-ring, a gap seal or a suitable coating of the interior of the annular groove and/or of the pole housing in the area of the annular groove.

The manufacture is especially simple and low-cost when the magnet housing is a one-piece extrusion-molded part. That part includes an inwardly aligned open pole tube on its bottom, opposite the actuating end, open to the exterior of the magnet housing. The magnet housing is also the reverse side of the pole body.

Other objects, advantages and salient features of the present invention will become apparent from the following detailed description, which, taken in conjunction with the annexed drawing, discloses a preferred embodiment of the present invention.

BRIEF DESCRIPTION OF THE DRAWING

Referring to the drawing which forms a part of this disclosure:

FIG. 1 is a side elevational view in section of an electromagnet connected with a multi-way valve according to an embodiment of the present invention.

DETAILED DESCRIPTION OF THE INVENTION

FIG. 1 illustrates an electromagnet 1 and a multi-way valve 2 to be actuated by the electromagnet. Electromagnet 1 has a magnet housing 3 constructed by extrusion molding and forming one integral part. The magnet housing has the shape of a circular cylindrical beaker, from the bottom part 5 of which a central tubular pipe or pole tube 7 extends inward. The central tubular pipe is formed during the extrusion-molding procedure. Within magnet housing 3, it forms a rear pole tube 7 of one integral piece with the housing.

Within magnet housing 3, a spool or bobbin 9, hereinafter spool 9, incorporates a magnetizing coil 11. The coil electrical connecting lugs 13 are guided outward through bottom openings 15 stamped out of bottom part 5 of magnet housing 3. On the interior of pole tube 7 and on the interior of spool 9, a thin walled tube 17 of nonmagnetic metal is engaged. The back or bottom of the tube 17 forms a guide for the armature piston 19. From its front, outwardly tapered part, the thin tube 17 extends along the interior of spool 9 as far as its front end facing connecting lugs 13.

Spool body 9 with magnetizing coil 11 and connecting lugs 13, inserted into magnet housing 3, is sprayed with insulating plastic. By means of built-in tube 17, the sprayed plastic material surrounds the exterior of the magnetizing coil 11 and fills the space between the coil and the interior of magnet housing 3. In this manner, an extruded connecting part 21 extends through bottom openings 15 as one integral spray-molded part formed on bottom part 5. The connecting part closes bottom openings 15 as well as the exterior opening of tube 17. This connecting part 21 also forms an integral plus part 23 for forming a contact with connecting lugs 13 of magnetizing coil 11. Also, connecting part 21 is of such configuration that a surrounding annular groove 25 is formed in it to receive an O-ring 27.

On the actuation end, an actuating pin 29, connected with armature piston 19, is accessible from the outside; and pole core 31 forms the actuation-side sealing of electromagnet 1. Pole core 31 includes a widened-out flange part 33, on the interior shoulder of which spool body 9 is supported. An encircling annular groove 35 extends into the exterior peripheral surface of flange part 33, and accommodates a sealing element in the form of an O-ring 37. Another annular groove 39 in magnet housing 3 is aligned with annular groove 35 such that magnet housing 3 contacts the interior walls of annular groove 35, forming a tightly fitting connection between magnet housing 3 and pole core 31. Since the groove 39 does not totally penetrate through the wall of magnet housing 3, an encircling sealing surface is also obtained. The contact of the magnet housing 3 on the O-ring 37 in annular groove 35 forms a connection providing a pressure-tight sealing of magnet housing 3.

Instead of the preferred O-ring 37, a sealing arrangement of a different type could also be provided as the sealing element. For example, a gap seal arrangement or a coating with a sealing material could be provided.

A part of pole core 31 extends along the interior of spool body 9 in axial alignment with pole tube 7, and has an annular groove accommodating an O-ring 41 for sealing off the tube 17 engaged on spool body 9. This projecting part of pole body 31 terminates in a conical or tapered socket surface 43 facing pole tube 7. Socket surface 43 is separated by an air gap 45 from the adjacent end of pole tube 7.

For pressure compensation, an interior axial bore 47 penetrates or extends through magnet or armature piston 19. Between armature piston 18 and the adjacent end of pole core 31, an adhesive-resistant plate 49 of the conventional type is located. Actuation pin 29 engages with its contact surface on valve piston 51 of multi-way valve 2 which is to be actuated. Valve piston 51 is pre-biased by a compression spring 53 into contact with actuation pin 29.

On the side of valve housing 54 predetermined for the application or connection of electromagnet 1, multi-way valve 2 has a widened-out collar 55. Magnet housing 3 is extended outward forming a free extension area 57 beyond groove 39. Extension area 57 is beaded to accommodate the fastening of valve housing 54 to the exterior end surface 59 of pole core 31 with collar 55 of valve housing 54.

Integration into one unit is obtained as a result of the overall spraying of spool body 9 by means of the incorporated tube 17, to form the assembly comprising magnet housing 3, spool 9 and tube 17. Simultaneously, thin walled tube 17 is thus being guided and controlled. Tube 17 seals off the magnet from the exterior on the oil side, and in turn simultaneously offers armature piston 19 its guiding, and causes the magnetic disconnection.

With the sealed-off construction of electromagnet 1 provided by the annular groove 25 with O-ring 27 on connecting part 21, oil-tight construction of electromagnet 1 in an oil chamber within a walled-off compartment or covering 61 is obtained. Since connecting part 21 projecting out of covering 61 is a plastic member and the other part of electromagnet 1 within covering 61 in the oil chamber is protected from exterior corroding influences, further exterior protection of electromagnet 1 against corrosion can be abandoned. Since tube 17 is supported on the exterior by the plastic material which has been sprayed on and on the interior of magnet housing 3 by spray-covered spool body 9, electromagnet 1 can withstand increased interior pressure loads.

While a particular embodiment has been chosen to illustrate the invention, it will be understood by those skilled in the art that various changes and modifications can be made therein without departing from the scope of the invention as defined in the appended claims.

What is claimed is:

1. An electromagnet for actuation of valves, comprising:

a sheath-like magnet housing being an extrusion-molded part forming one integrated piece and having a bottom part;

a pole core encompassed by said housing on an actuation side of the electromagnet, said bottom part of said housing being opposite the actuation side;

a magnet armature movably mounted in said housing;

an actuation member connected to and moved by said magnet armature;

a sealed connection between said magnet housing and said pole core on the actuation side including a first annular groove extending into a periphery of said pole core, a sealing element fitted in said first annular groove and a second annular groove in said magnet housing, said second annular groove forming contact surfaces on said magnet housing tightly engaging on interior walls of said first annular groove and forming an encompassing sealing surface engaging said sealing element; and a pole tube on said bottom part aligned with and extending inwardly toward a reverse side of said pole core.

2. An electromagnet according to claim 1 wherein said sealing element is an O-ring.

3. An electromagnet according to claim 1 wherein said magnet housing, on the actuation side of the electromagnet, extends and forms an extension area projecting over an exterior end surface of said pole core, said extension area being connected with a structural part actuated by the electromagnet.

4. An electromagnet according to claim 3 wherein said structural part comprises a valve housing connected with said magnet housing, and comprises a collar engaging and adjacent said end surface of said pole core, said collar being connected with said extension area of said magnet housing by beading.

5. An electromagnet according to claim 1 wherein said bottom part forms a connection side of the electromagnet, and has an opening formed by said pole tube and a plurality of bottom openings; and a spool body carries a magnetizing coil in an interior of said magnet housing, and is sprayed to form an integral connecting part sprayed therein that extends outwardly from said magnetizing coil through said bottom openings of said magnet housing to provide an electrical connection and to close said openings formed by said pole tube and said plurality of bottom openings.

6. An electromagnet according to claim 5 wherein said connecting part comprises an exterior part extending out of said bottom openings of said magnet housing, said exterior part having a peripheral annular groove receiving an O-ring.

7. An electromagnet according to claim 6 wherein said connecting part comprises a plug part, formed as one integral piece therewith, for electrical connections to said magnetizing coil.

8. An electromagnet according to claim 5 wherein a thin walled tube of nonmagnetic material extends about and guides movement of said magnet armature, and is sprayed together with said spool body and said connecting part.

9. An electromagnet according to claim 8 wherein said pole core extends from an end surface thereof incorporating said first annular groove along said thin walled tube;

said thin walled tube extends on an interior of said spool body; and said pole core comprises an annular groove receiving an O-ring forming a seal with said thin walled tube.

10. An electromagnet according to claim 9 wherein a part of said pole core extends along the thin walled tube for aligning a magnetic field, and terminates in a tapered socket facing an adjacent end of a pole tube on said magnet housing and spaced therefrom by an air gap.

11. An electromagnet for actuation of valves, comprising:

a sheath-like magnet housing, said magnet housing on an actuation side of the electromagnet extending and forming an extension area, said extension area being connected with a structural part actuated by the electromagnet;

a pole core encompassed by said housing on an actuation side of the electromagnet, said extension area projecting over an exterior end surface of said pole core;

a magnet armature movably mounted in said housing;

an actuation member connected to and moved by said magnet armature; and a sealed connection between said magnet housing and said pole core on the actuation side including a first annular groove extending into a periphery of said pole core, a sealing element fitted in said first annular groove and a second annular groove in said magnet housing, said second annular groove forming contact surfaces on said magnet housing tightly engaging on interior walls of said first annular groove and forming an encompassing sealing surface engaging said sealing element.

12. An electromagnet according to claim 11 wherein said structural part comprises a valve housing connected with said magnet housing, and comprises a collar engaging and adjacent said end surface of said pole core, said collar being connected with said extension area of said magnet housing by beading.

13. An electromagnet according to claim 11 wherein said magnet housing comprises a bottom part forming a connection side of the electromagnet and having an opening formed by a pole tube and a plurality of bottom openings; and a spool body carries a magnetizing coil in an interior of said magnet housing, and is sprayed to form an integral connecting part sprayed therein that extends outwardly from said magnetizing coil through said bottom openings of said magnet housing to provide an electrical connection and to close said openings formed by said pole tube and said plurality of bottom openings.

14. An electromagnet according to claim 13 wherein said connecting part comprises an exterior part extending out of said bottom openings of said magnet housing, said exterior part having a peripheral annular groove receiving an O-ring.

15. An electromagnet according to claim 14 wherein said connecting part comprises a plug part, formed as one integral piece therewith, for electrical connections to said magnetizing coil.

16. An electromagnet according to claim 13 wherein a thin walled tube of nonmagnetic material extends about and guides movement of said magnet armature, and is sprayed together with said spool body and said connecting part.

17. An electromagnet according to claim 16 wherein said pole core extends from an end surface thereof incorporating said first annular groove along said thin walled tube;

said thin walled tube extends on an interior of said spool body; and said pole core comprises an annular groove receiving an O-ring forming a seal with said thin walled tube.

18. An electromagnet according to claim 17 wherein a part of said pole core extends along the thin walled tube for aligning a magnetic field, and terminates in a tapered socket facing an adjacent end of said pole tube on said magnet housing and spaced therefrom by an air gap.

19. An electromagnet for actuation of valves, comprising:

a sheath-like magnet housing, said magnet housing having a bottom part forming a connection side of the electromagnet, said bottom part having an opening formed by a pole tube and a plurality of bottom openings;

a pole core encompassed by said housing on an actuation side of the electromagnet;

a magnet armature movably mounted in said housing;

an actuation member connected to and moved by said magnet armature;

a sealed connection between said magnet housing and said pole core on the actuation side including a first annular groove extending into a periphery of said pole core, a sealing element fitted in said first annular groove and a second annular groove in said magnet housing, said second annular groove forming contact surfaces on said magnet housing tightly engaging on interior walls of said first annular groove and forming an encompassing sealing surface engaging said sealing element; and a spool body carrying a magnetizing coil in an interior of said magnet housing, said spool body being sprayed to form an integral connecting part sprayed therein that extends outwardly from said magnetizing coil through said bottom openings of said magnet housing to provide an electrical connection and to close said openings formed by said pole tube and said plurality of bottom openings.

20. An electromagnet according to claim 19 wherein said connecting part comprises an exterior part extending out of said bottom openings of said magnet housing, said exterior part having a peripheral annular groove receiving an O-ring.

21. An electromagnet according to claim 19 wherein said connecting part comprises a plug part, formed as one integral piece therewith, for electrical connections to said magnetizing coil.

22. An electromagnet according to claim 19 wherein a thin walled tube of nonmagnetic material extends about and guides movement of said magnet armature, and is sprayed together with said spool body and said connecting part.

23. An electromagnet according to claim 22 wherein said pole core extends from an end surface thereof incorporating said first annular groove along said thin walled tube;

said thin walled tube extends on an interior of said spool body; and said pole core comprises an annular groove receiving an O-ring forming a seal with said thin walled tube.

24. An electromagnet according to claim 23 wherein a part of said pole core extends along the thin walled tube for aligning a magnetic field, and terminates in a tapered socket facing an adjacent end of said pole tube on said magnet housing and spaced therefrom by an air gap.

* * * * *